United States Patent [19]

Wollner

[11] 4,294,451

[45] Oct. 13, 1981

[54] SLOT MACHINE CARD GAME

[76] Inventor: Robert A. Wollner, 5547 Yarmouth Ave., Apt. #9, Encino, Calif. 91316

[21] Appl. No.: 70,244

[22] Filed: Aug. 27, 1979

[51] Int. Cl.[3] ..... A63F 1/00

[52] U.S. Cl. ..... 273/308; 273/304

[58] Field of Search ..... 273/292, 297, 303, 304, 273/305, 306, 308

[56] References Cited

U.S. PATENT DOCUMENTS

| | | | |
|---|---|---|---|
| 1,129,423 | 2/1915 | Parker | 273/305 |
| 1,526,597 | 2/1925 | Harris | 273/303 |
| 1,584,180 | 5/1926 | Martin | 273/306 |
| 2,607,595 | 8/1952 | Mathes | 273/304 |
| 3,667,757 | 6/1972 | Holmberg | 273/274 |

OTHER PUBLICATIONS

Gift and Art Buyer, Sep. 1943, p. 82, 273-292.

*Primary Examiner*—Anton O. Oechsle
*Attorney, Agent, or Firm*—Jack C. Munro

[57] ABSTRACT

A card game which is to be played with a plurality of cards wherein the cards are divided into several groups. The division between the groups takes the form of indicia in the form of different objects, with there being a single different object for each group of cards. Each card within each group also includes second indicia in the form of a numerical value, with there being different numerical values within each group. Several of the groups of cards also include a third indicia which is in the form of a numerical value with this numerical value being the same for each card within a group.

1 Claim, 6 Drawing Figures

SLOT MACHINE CARD GAME

BACKGROUND OF THE INVENTION

The field of this invention relates to games, and more particularly to a game which is played with a plurality of playing cards.

The playing of games with playing cards is most common. There are substantial numbers of playing card games, and because there are so many different playing card games, there is a substantial variety in the type of play of such games. Whether one particular playing card game is better to play than another one takes into consideration several factors, such as the interest of the players, whether the game includes the element of skill, or whether the game includes the element of chance, the relationship between chance and skill, complexity, simplicity, and so forth.

SUMMARY OF THE INVENTION

The playing cards used in the playing of the games of this invention are summarily described in the Abstract of the Disclosure, and reference is to be had thereto.

The primary objective of the game of this invention is to construct a playing card arrangement which can be used to play several types of games which are interesting and challenging to play by a plurality of players, and which can be constructed inexpensively, thereby minimizing manufacturing costs.

DETAILED DESCRIPTION OF THE PREFERRED EMBODIMENT

Figure 1:
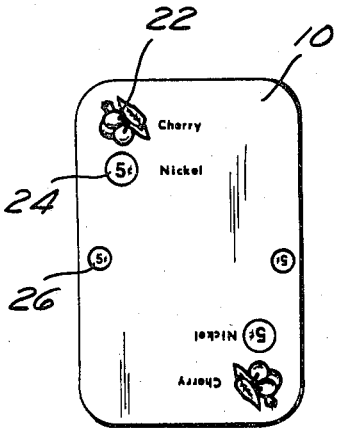
FIGS. 1–6 show the different types of playing cards which are employed in conjunction with the playing card game of this invention.
Figure 2:
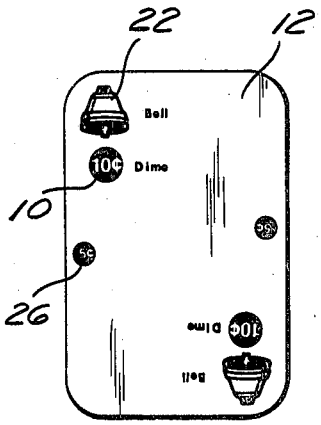

Referring particularly to the drawings, there is shown rectangularly shaped sheet material playing cards 10, 12, 14, 16, 18, and 20. Playing card 10 is of a particular group of cards, playing card 12 is of another group of cards, etc., so that there is in essence ten in number of different groups of cards employed in conjunction with the playing of this game. Within each group of cards, there are six in number of cards. Four in number of card groups are not shown. The total number of cards is sixty.

The division between the different groups of cards is due to first indicia in the form of object representations 22. Each object representation 22 is on the face of each card and is duplicated at opposite corners of the card. The different object representations 22 are the ones shown, the cherry, the bell, the bar, the double bar, the seven and the slot machine. Object representations which are not shown in the drawings and which are included within the game of this invention are the plum, the lemon, the orange and the watermelon. These object representations are frequently used in gambling machines, such as slot machines.

Figure 3:
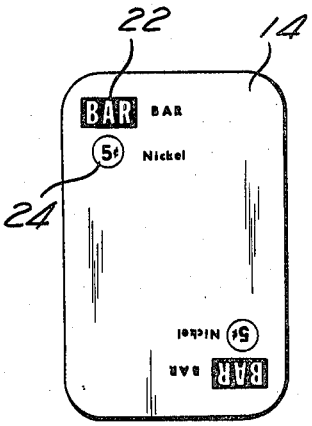
Figure 4:
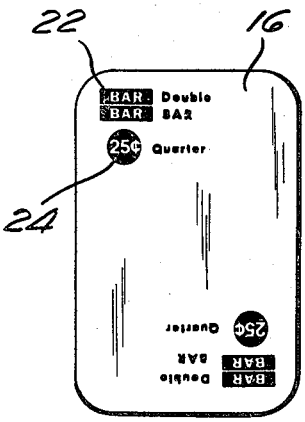
Figure 5:
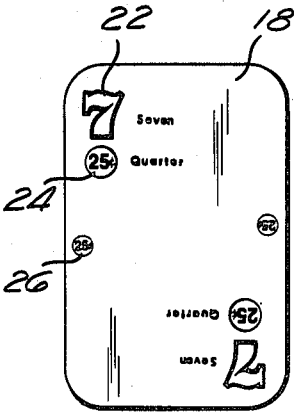
Figure 6:
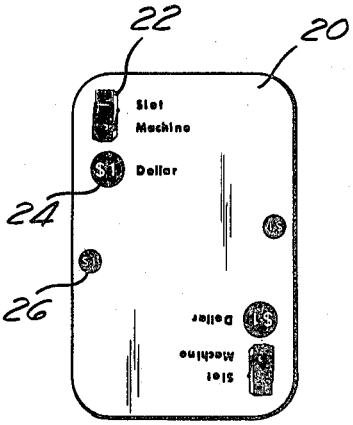

Each card also includes second indicia 24 in the form of a numerical value. The different numerical values 24 may comprise either 5¢(nickel), ten cents (dime), twenty-five cents (quarter), or one dollar. Each card within each group of cards also includes a third indicia 26 which is in the form of a numerical value, with the exception that there is no third indicia on the bar cards of FIGS. 3 and 4. The reason for this will become apparent in the following description of how to play the different types of games. The third indicia 26 may take either of the aforementioned previous values, that being five cents, ten cents twenty-five cents, or a dollar.

Each card within each group of cards is to include the same first indicia 22, that being all cherrys, or all bells, etc. Also, the third indicia for a particular group of cards is identical, that is, all five cents, all ten cents, all twenty-five cents, or all dollar. The second indicia for each group of cards varies. An example would be for one group of cards to have two dollar amounts, two twenty-five cent amounts and one ten cent amount and one nickel amount. Another group of cards may have three twenty-five cent amounts, one dollar amount, one ten cent amount and one five cent amount. However, in the overall group of cards, there is to be a total of fifteen five cent amounts, fifteen ten cent amounts, fifteen twenty-five amounts, and fifteen dollar amounts, making up the total of sixty cards.

The second indicia 24, as well as the third indicia 26, are divided up into two different colors, that being white and black, or any other convenient colors. There is to be an equal number of cards in one color and an equal number of cards in another color. The purpose of the colors is, again, for the purpose of playing certain games which will be described further on in the specification.

Examples of different types of games are as follows:

The purpose of one type of game is for the players to try to get a single, double or triple jackpot. A single jackpot would be three of the same type of first indicia in a row and a double jackpot would be two different series of three each of different types of first indicia 22, and a triple jackpot would be three different series of three different types of first indicia 22. This jackpot type of game can be played wherein the cards are arranged face down in a particular pattern on a planar surface such as a table, and the cards are then turned up and the jackpots (if any) are then counted.

The second indicia 24 would be to get a single jackpot, wherein all the numerical values of the second indicia 24 match, as for example, three bells and three ten cent values. It is to be noted that within each group of cards there are only three cards having the same numerical value of second indicia 24. Therefore, these exact cards must be obtained within a single group.

A poker-style jackpot can also be played, wherein four matching first indicia 22 would have a very high value, a slightly less value would be three sevens with a bottom value being a single first indicia, such as a cherry, seven, etc. Also, matching values of the indicia 26 would have a certain value and if they happen to be all of the same color, they would have a higher value.

Another game to be played with this invention is by each player to add up the total amount of the indicias 24 and the player with the highest value would be the winner.

The cards also may be dealt in a pattern of three horizontal rows and three vertical rows, which is similar to the playing section of a slot machine. Any identical row of three of first indicias 22 would result in a jackpot.

The cards of the present invention can be used to play numerous games, with the aforementioned being only a small sample of the games. Actually, a group of players could readily manufacture their own game.

What is claimed is:

1. A card game comprising:

a plurality of cards, said cards being divided into several different groups with there being ten in number of said groups, there also being an equal number of said cards within each of said groups, the basic format of the different card groups being similar, each said card having a first indicia with there being several different first indicias, each said first indicia comprising symbols from the group consisting of fruits, bar representations, enlarged single numerals, and a slot machine with only a single said object represented on a single card, each said group of cards having identical first indicia;

second indicia located on each card of said cards, said second indicia comprising monetary numerical values, there being different said monetary numerical values within each said group with each said card having only a single monetary value of said second indicia; and third indicia located on each of said cards within certain said groups of cards, said third indicia comprising different monetary numerical values with there being the identical monetary numerical value used entirely throughout each of said certain groups.

* * * * *